US007197275B2

(12) United States Patent
Yasui

(10) Patent No.: US 7,197,275 B2
(45) Date of Patent: Mar. 27, 2007

(54) IMAGE FORMING APPARATUS AND IMAGE FORMING METHOD INCLUDING LOW-NOISE MODE AT PAPER SHEET REVERSE SECTION

(75) Inventor: Kazumasa Yasui, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 73 days.

(21) Appl. No.: 11/176,380

(22) Filed: Jul. 8, 2005

(65) Prior Publication Data

US 2005/0251286 A1 Nov. 10, 2005

Related U.S. Application Data

(62) Division of application No. 10/462,679, filed on Jun. 17, 2003, now Pat. No. 6,931,230.

(30) Foreign Application Priority Data

Jun. 18, 2002 (JP) ..... 2002-176624

(51) Int. Cl.
*G03G 15/00* (2006.01)

(52) U.S. Cl. ..... 399/396; 399/401

(58) Field of Classification Search ..... 399/388, 399/394, 396, 401; 271/184, 185, 186, 202, 271/203, 314, 3.15, 3.16, 3.17
See application file for complete search history.

(56) References Cited

U.S. PATENT DOCUMENTS

| | | | | |
|---|---|---|---|---|
| 6,577,844 | B2 * | 6/2003 | Kamei | 399/401 |
| 6,626,428 | B2 | 9/2003 | Soga et al. | |
| 6,690,911 | B2 * | 2/2004 | Yamagishi | 399/405 |
| 6,751,437 | B2 * | 6/2004 | Shimazu | 399/396 |
| 6,836,641 | B2 | 12/2004 | Uchida et al. | |

FOREIGN PATENT DOCUMENTS

JP 9-272648 A 10/1997

* cited by examiner

*Primary Examiner*—Ren Yan
(74) *Attorney, Agent, or Firm*—Foley & Lardner LLP

(57) ABSTRACT

An image forming apparatus and image forming method including a low-noise mode at paper sheet reverse section to decrease a reverse convey speed of reverse conveyance by a reverse roller pair, where necessary, a reverse convey speed of reverse conveyance.

7 Claims, 6 Drawing Sheets

IMAGE FORMING APPARATUS AND IMAGE FORMING METHOD INCLUDING LOW-NOISE MODE AT PAPER SHEET REVERSE SECTION

CROSS-REFERENCE TO RELATED APPLICATIONS

The present application is a Divisional of U.S. application Ser. No. 10/462,679, filed Jun. 17, 2003 now U.S. Pat. No. 6,931,230, the entire contents of which is incorporated herein by reference.

This application is based upon and claims the benefit of priority from the prior Japanese Patent Application No. 2002-176624, filed Jun. 18, 2002, the entire contents of which are incorporated herein by reference.

BACKGROUND OF THE INVENTION

1. Field of the Invention

The present invention relates to an image forming apparatus such as a digital copying machine or a printer, and to a control method for the image forming apparatus.

2. Description of the Related Art

In a conventional digital copying machine, when a copying operation is performed, an original is fed to a scan mechanism and a paper sheet is fed to a print/output mechanism. Thus, the copying operation is executed. In this operation, there is a case where a sheet-reversing section for reversing a paper sheet is provided in front of the output mechanism.

Specifically, in order to successively output copied paper sheets in the order of page numbers, the obverse and reverse sides of a conveyed paper sheet are turned upside down by the sheet-reversing section. In addition, in order to perform double-side printing, a paper sheet having an image on its one side is reversed by the sheet-reversing section and brought to an automatic double-side unit.

However, when a paper sheet is set in a sheet feed cassette of a digital copying machine, for example, when a thick paper sheet is set, the thick sheet (e.g. 209 g sheet), which has a greater thickness (and a greater resiliency) than an ordinary paper sheet, may cause friction with the guide member of the convey path. As a result, large friction noise is produced when the thick paper sheet passes through a guide-shaped R-portion (reversing section).

Besides, in a modern high-speed machine, a sheet feed interval of paper sheets is decreased to increase a copy productivity (CPM: copy per minute). In this case, in order to reverse and output (or discharge) the sheet, the sheet convey speed at the reversing section needs to be increased. To achieve this, a speed acceleration control is executed to accelerate the sheet convey speed at the time of reversing the sheet. Specifically, a paper sheet on which an image is formed is fed at a constant speed until it passes through a fixing device. After a rear end of the sheet comes out of the fixing device, the convey speed is accelerated at a predetermined timing.

In the apparatus where the sheet-reverse section is used to effect both operations for the reversed-sheet output and the sheet reverse conveyance to the automatic double-side unit, the sheet-reversing positions for the respective operations are determined. The sheet-reversing positions are determined by the timing provided by sensors disposed in the convey path. In short, as the convey speed increases, a variation increases in the sheet-reversing position due to an error in timing or a slip of rollers.

In addition, in general, a sheet-reverse position for refeeding the sheet to the automatic double-side unit is set on the downstream side of a sheet-reverse position for reversing the sheet and outputting the reversed sheet. In a case where an LD sheet with a large length is used, if the sheet-reverse position shifts to the downstream side, a front edge of the sheet abuts upon an end wall of the convey path, resulting in folding of the sheet or noise due to abutment.

On the other hand, if the sheet-reverse position shifts to the upstream side, the reverse conveyance to the automatic double-side unit would begin before the sheet does not completely come out of the convey path. As a result, a jam may occur in the vicinity of the entrance of the automatic double-side unit or noise of abutment may occur in the convey path.

Furthermore, the sheet-reverse position alters due to the convey speed. If there is a variance among machines due to precision of parts, such as a roller diameter, or assembling, the sheet-reverse position would vary. As a result, like the above-mentioned case, such problems as folding of paper, jamming or noise due to abutment may arise.

BRIEF SUMMARY OF THE INVENTION

The object of the present invention is to provide an image forming apparatus and an image forming method thereof, which can reduce noise at a sheet-reversing section and can prevent problems such as jamming.

In order to achieve the object, the present invention may provide an image forming apparatus and an image forming method which forms an image on a paper sheet that is fed, comprising:

an image forming section that forms on a paper sheet an image; and a reversing section that reverses the paper sheet in convey direction, on one side of which an image is formed by the image forming section, wherein reverses the paper sheet in a first reverse convey speed (V1) when a first mode is performed, and reverses the paper sheet in a second reverse convey speed (V2) that is slower than the first reverse convey speed (V1) when a second image formation mode is performed. Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will now be described with reference to the accompanying drawings.

Figure 1:
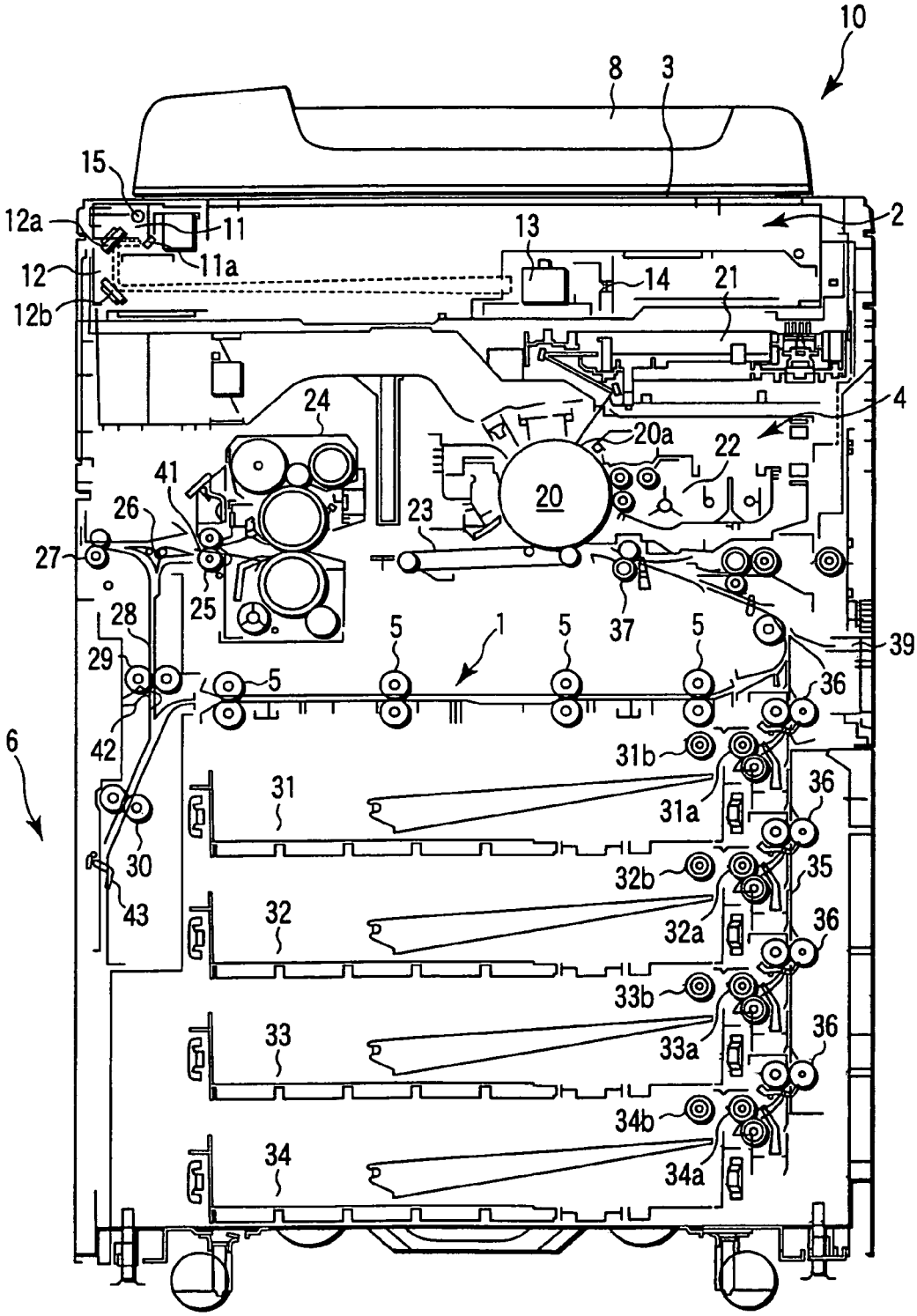
FIG. 1 is a cross-sectional view schematically showing the structure of a digital copying machine according to an embodiment of the present invention.

FIG. 1 shows a schematic structure of a digital copying machine 10 including an automatic double-side unit 1 according to an embodiment of the invention. The automatic double-side unit (ADU) 1 receives a paper sheet, on one side of which an image is formed, from a printer section 4 (that contains an image forming section) (to be described later) in the digital copying machine 10. The automatic double-side unit 1 automatically reverses the sheet and feeds it to the printer section 4 once again.

As is shown in FIG. 1, the digital copying machine 10 includes a scanner section 2 that reads an image on an original and acquires image data; the aforementioned printer section 4 that forms on a paper sheet an image; the automatic double-side unit 1 that successively reverses paper sheets, on one side of each of which an image is formed by the printer section 4, and feeds them to the printer section 4 once again; and a sheet feed section 6 that feeds paper sheets of desired sizes to the printer section 4. In addition, an automatic document feeder (ADF) 8 is openably disposed on top of the digital copying machine 10. The ADF 8 serves as a cover for holding an original placed on an original table 3, and automatically feeds a plurality of originals one by one onto the original table 3.

The scanner section 2 includes a first carriage 11 formed to be movable in parallel with the original table 3 under the original table 3; a second carriage 12 that is movable following movement of the first carriage 11; a lens 13 that provides predetermined focusing characteristics to reflective light (image light) from the original, which is sent from the first and second carriages 11 and 12; and a photoelectric conversion element (CCD sensor) 14 that photoelectrically converts the image light which is provided with the predetermined focusing characteristics by the lens 13, thus acquiring image data.

The original placed on the original table 3 is illuminated by a light source 15 provided on the first carriage 11 as one piece. Image light reflected from the original is successively reflected by a first mirror 11*a* mounted on the first carriage 11, and second and third mirrors 12*a* and 12*b* mounted on the second carriage 12. The reflective light is then focused on the CCD sensor 14 via the lens 13. At this time, the first carriage 11 and second carriage 12 are moved along the original table 3 at predetermined speed. Thereby, image light associated with the entire surface of the original is received by means of the CCD sensor 14, and image data relating to the image on the entire surface of the original is acquired.

The printer section 4 includes an image forming section comprising: an exposing device 21 that emits a laser beam; a photosensitive drum 20 that is scanned and exposed with the laser beam emitted from the exposing device 21 so that an electrostatic latent image is formed on an outer peripheral surface 20*a* of the photosensitive drum 20, which is pre-charged with a predetermined potential; a developing device 22 that applies toner to, and thus develops, the electrostatic latent image formed on the outer peripheral surface 20*a* of the photosensitive drum 20; a transfer belt 23 that transfers the developed toner image onto a paper sheet fed from the sheet feed section 6 (to be described later) at a predetermined timing; and a fixing device 24 that fixes the toner image, which has been transferred on the paper sheet, on the paper sheet.

The electrostatic latent image formed on the outer peripheral surface 20*a* of the photosensitive drum 20 by the exposure/scan by the exposing device 21 is developed into a visible toner image by the toner supplied from the developing device 22. The visible toner image on the outer peripheral surface 20*a* is moved by the rotation of the photosensitive drum 20, and transferred onto the paper sheet fed from the sheet feed section 6 (to be described later). The toner image transferred on the sheet is heated and fused by the fixing device 24, and thus the toner image is fixed on the sheet.

The sheet, on one side of which an image is formed by the fixation of the toner image, is delivered to a direction-switching gate 26 via an image-fixed sheet output roller pair 25. The direction-switching gate 26 is switched to output the sheet to the outside of the machine via an output roller pair 27, or feeds the sheet to the automatic double-side unit 1 via a reverse convey path 28, a reverse roller pair 29 and an ADU reverse roller pair 30, which are described later.

An actuator-type sensor 41 is provided near the image-fixed sheet output roller pair 25. An actuator-type sensor 42 is provided immediately after the reverse roller pair 29 in a forward convey direction of the sheet. An actuator-type sensor 43 is provided immediately after the ADU reverse roller pair 30 in the forward convey direction of the sheet.

A reversing section that reverses the paper sheet, on one side of which an image is formed by the image forming section, when the setting section sets one of relating to a reverse sheet output single-side image formation mode (normal mode) that is a first mode, when the setting section sets double-side image formation mode that is a second mode reverses a conveying direction of the paper sheet and conveys the paper toward the automatic double-side unit 1.

Further, there are provided a motor 51 (to be described later) for driving the fixing device 24 and image-fixed sheet output roller pair 25, and a motor 52 (to be described later) for driving the reverse roller pair 29 and ADU reverse roller pair 30. With this structure, an optimal control for a fixation speed and a reverse convey speed can be performed in the present invention.

The automatic double-side unit 1 has a plurality of convey roller pairs 5. The sheet feed section 6 includes a plurality of sheet feed cassettes 31, 32, 33 and 34 containing a plurality of paper sheets of different sizes.

Pick-up rollers 31*b*, 32*b*, 33*b* and 34*b* for picking up sheets one by one from the uppermost ones, which are contained in the associated sheet feed cassettes 31, 32, 33 and 34, are provided near feed-side end portions (right-hand end portions in FIG. 1) of the sheet feed cassettes 31, 32, 33 and 34. Sheet feed rollers 31*a*, 32*a*, 33*a* and 34*a* are provided adjacent to the pick-up rollers 31*b*, 32*b*, 33*b* and 34*b* on the downstream side of the pick-up rollers 31*b*, 32*b*, 33*b* and 34*b* in the direction in which the sheets are taken out. A paper sheet selectively taken out of the sheet feed cassettes 31, 32, 33 and 34 by the pick-up rollers 31*b*, 32*b*, 33*b* and 34*b* and sheet feed rollers 31*a*, 32*a*, 33*a* and 34*a* is conveyed upward (in FIG. 1) via a plurality of convey roller pairs 36 provided along a sheet convey path 35. The conveyed sheet is fed to an aligning roller pair 37 provided in front of the photosensitive drum 20 of the printer section 4.

A manual feed device 39 for manually feeding a paper sheet is provided upward of the sheet feed cassette 31. The paper sheet fed via the manual feed device 39 is delivered to the aligning roller pair 37.

A front edge of the paper sheet fed to the aligning roller pair 37 from the sheet feed cassette, 31, 32, 33, 34, of the sheet feed section 6 or from the manual feed device 39 is once aligned by the aligning roller pair 37. Then, the aligning roller pair 37 is rotated in synchronism with the timing of the image forming operation in the printer section 4. Thus, the sheet is fed to a transfer region between the transfer belt 23 and photosensitive drum 20. In this manner, the above-mentioned toner image is transferred onto the sheet fed to the transfer region.

Figure 2:
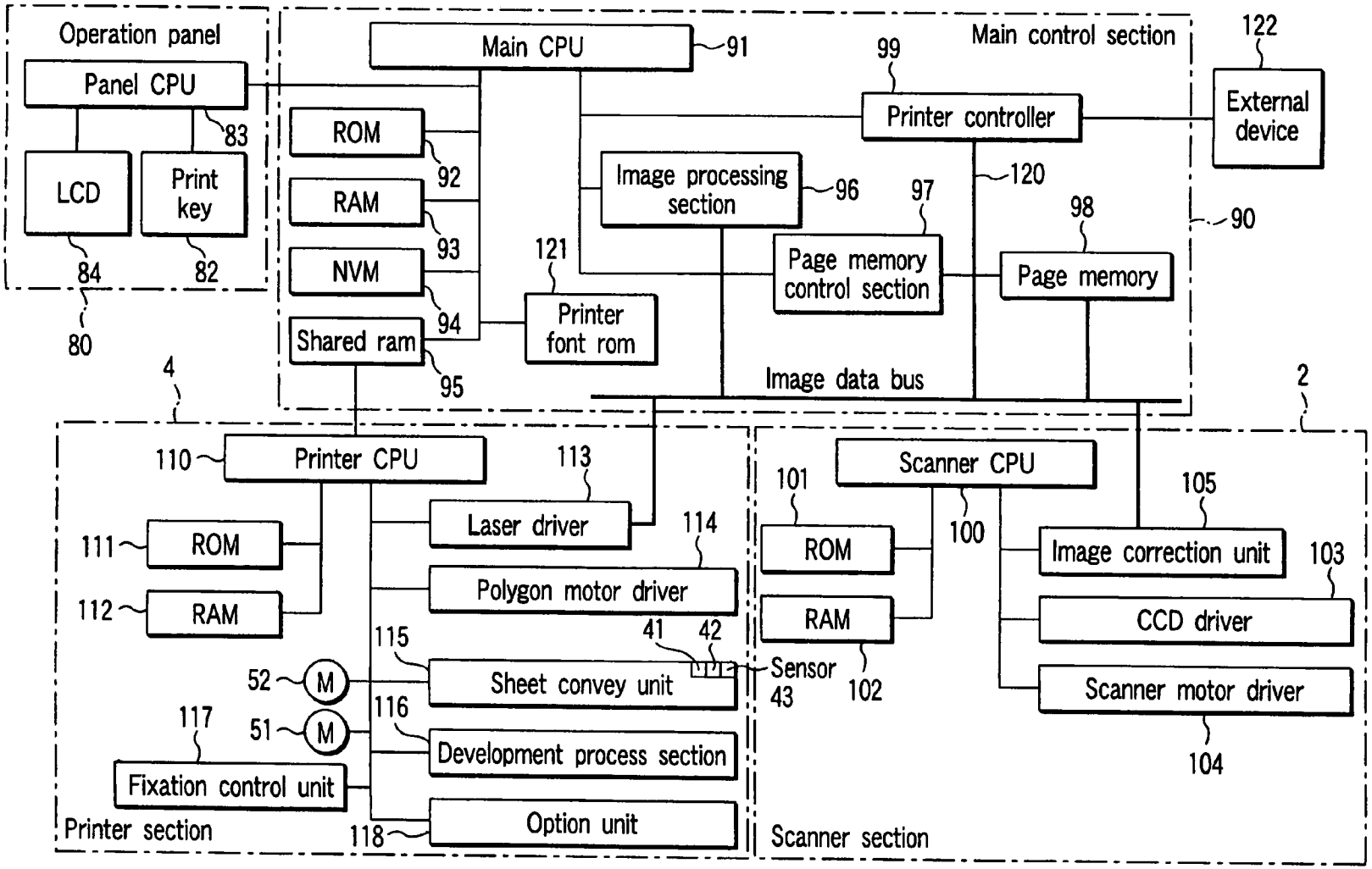
FIG. 2 is a block diagram schematically showing electrical connection of the digital copying machine and flow of signals for control.

FIG. 2 is a block diagram schematically showing electrical connection of the digital copying machine 10 shown in FIG. 1 and flow of signals for control. In FIG. 2, a control system of the digital copying machine 10 comprises three CPUs: a main CPU 91 provided in a main control section 90; a scanner CPU 100 in the scanner section 2; and a printer CPU 110 in the printer section 4. The main CPU 91 performs bi-directional communication with the printer CPU 110 via a shared RAM 95. The main CPU 91 issues an operational instruction, and the printer CPU 110 returns status data. Serial communication is performed between the printer CPU 110 and scanner CPU 100. The printer CPU 110 issues an operational instruction, and the scanner CPU 100 returns status data.

An operation panel 80 is connected to the main CPU 91. The operation panel 80 comprises a print key 82 that instructs the start of a copying operation, a panel CPU 83 that controls the entirety of the operation panel 80, and a liquid crystal display (LCD) section 84 having a touch panel for operational inputs.

The main control section 90 comprises the main CPU 91, a ROM 92, a RAM 93, an NVRAM 94, a shared RAM 95, an image processing section 96, a page memory control unit 97, a page memory 98, a printer controller 99, and a printer font ROM 121.

The main CPU 91 controls the entirety of the main control section 90. The ROM 92 stores control programs. The RAM 93 temporarily stores various data.

The NVM (Non-Volatile RAM) 94 is a non-volatile memory backed up by a battery (not shown). Even when power is not supplied to the NVM 94, stored data is maintained.

The shared RAM 95 is used to perform bidirectional communication between the main CPU 91 and printer CPU 110.

The page memory controller 97 stores and reads out image data in and from the page memory 98. The page memory 98 has areas capable of storing image data of a plurality of pages. The page memory 98 can store compressed data in units of a page, which is obtained by compressing image data from the scanner section 2.

The printer font ROM 121 stores font data corresponding to print data.

The printer controller 99 develops print data, which is sent from an external device 122 such as a personal computer, into image data using the font data stored in the printer font ROM 121 with a resolution corresponding to resolution data added to the print data.

The scanner section 2 comprises the scanner CPU 100 for controlling the entirety of the scanner section 2; a ROM 101 storing control programs, etc.; a data storage RAM 102; a CCD driver 103 for driving the CCD sensor 14; a scan motor driver 104 for controlling the rotation of a scan motor for moving the light source 15, first mirror 11*a*, second mirror 12*a*, third mirror 12*b*, etc.; and an image correction unit 105.

The image correction section 105 comprises an A/D converter for converting analog signals output from the CCD sensor 14 to digital signals; a shading correction circuit for correcting a variance in the CCD sensor 14, or a variation in threshold level due to ambient temperature variation relative to the output signal from the CCD sensor 14; and a line memory for temporarily storing shading-corrected digital signals from the shading correction circuit.

The printer section 4 comprises the printer CPU 110 for controlling the entirety of the printer section 4; a ROM 111 storing control programs, etc.; a data storage RAM 112; a laser driver 113 for turning on/off the exposing device 21 that emits a laser beam; a polygon motor driver 114 for controlling the rotation of the polygon motor of the exposing device 21; a sheet convey unit 115 for controlling conveyance of the sheet; a development process section 116 for controlling charging, developing and transferring processes using the developing device 22 and transfer belt 23; a fixation control unit 117 for controlling the fixing device 24; and an option unit 118.

The aforementioned sensors 41, 42 and 43 are included in the sheet convey unit 115. The aforementioned motors 51 and 52 are included in the printer section 4.

The image processing section 96, page memory 98, printer controller 99, image correction section 105, and laser driver 113 are connected over an image data bus 120.

A first embodiment of the present invention with the above-described structure will now be described.

Sheet reverse conveyance is described referring to FIG. 1.

In an upstream side of the reverse section, a sheet on which an image is formed by the printer section 4 is conveyed by the image-fixed sheet output roller pair 25, and then brought to the reverse convey path 28 via the direction-switching gate 26. In a sheet feed interval T1 (sheet feed timing) in a normal mode that is the first mode, a sheet convey speed is 400 mm/sec. At the time of reverse conveyance, the sheet convey speed is controlled and accelerated up to 800 mm/sec. In the reverse convey path 28, the sheet is fed forward at high speed by the reverse roller pair 29 for a prescribed time after passing through the nip between the image-fixed sheet output rollers 25. After the sensor 42 detects the rear edge of the sheet being fed by the reverse roller pair 29, the reverse rollers are rotated in the reverse direction at a preset timing. The reverse roller pair 29 convey the sheet backwards. The sheet, thus fed by the reverse roller pair 29, is output from the machine as the direction-switching gate 26 is switched.

The sheet conveyed is guided by a guide (not shown) for ensuring exact conveyance.

In the first embodiment, in the sheet reverse conveyance, noise occurring at the time of forming a thick-sheet copy (roller noise at the time of reversing, noise of friction between the guide and thick sheet, etc.) is reduced. Compared to the aforementioned normal mode that is the first, a thick paper sheet mode (low-speed mode or low-noise mode) that is the second mode is set in the reverse conveyance.

For example, when a 209 g/m$^2$ sheet is fed as a thick sheet, compared to an ordinary sheet, within the digital copying machine 10, noise of friction between the guide and the thick sheet occurs due to the thickness of the sheet (high resiliency of the thick sheet). In particular, large noise occurs when the thick sheet passes along a guide-shaped R section (reversing section).

To cope with this problem, in the thick paper sheet mode (low-speed mode or low-noise mode) of the first embodiment, when the reverse conveyance is performed, the sheet feed interval T 2 (feed timing) in the thick paper sheet mode (that is the second mode) is controlled to become longer than the sheet feed interval T 1 in the normal mode that is the first mode. In the normal mode, a first reverse convey speed (V1) is 800 mm/sec, whereas in the thick paper mode (low-speed mode or low-noise mode) is set at 600 mm/sec that is a second reverse convey speed (V2) which slower than the first revere convey speed (V1).

Figure 3:
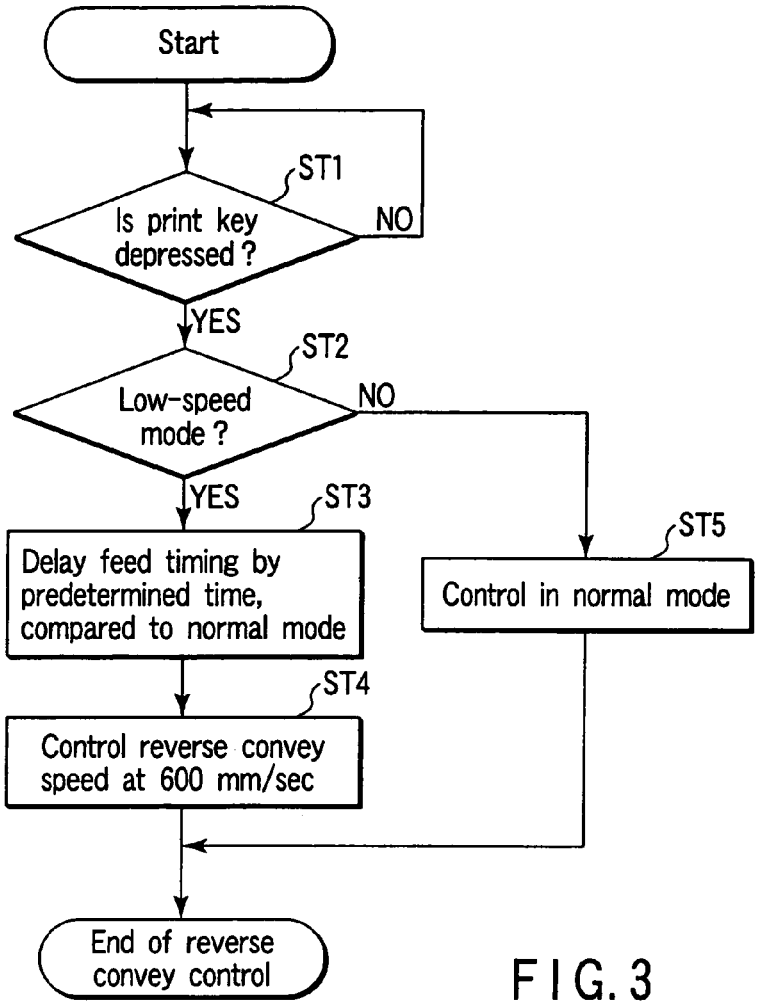
FIG. 3 is a flow chart illustrating a control operation according to a first embodiment of the invention.

The control operation in the first embodiment with the above structure will now be described with reference to a flow chart of FIG. 3.

To start with, the thick paper sheet mode (low-speed mode or low-noise mode) that is a second mode is set in any one of the sheet feed cassettes 34. Assume that the thick sheet is set in the sheet feed cassette 34.

The sheet feed cassette 34 is selected through the LCD section 84 of the operation panel 80 and the thick paper sheet mode is selected, and the print key 82 is depressed (ST1). Then, the main CPU 91 determines whether the thick paper sheet mode is set through the LCD section 84 (ST2).

If the thick paper sheet mode is set, the printer CPU 110 delays the timing of sheet feed from the sheet feed cassette 34 by a predetermined time, compared to the normal mode (ST3).

Further, the printer CPU 110 controls the motor 52 to set the reverse convey speed of the reverse roller pair 29 at 600 mm/sec (V2), which is slower than in the normal mode (the reverse sheet output single-side image formation mode) that is the first mode (ST4).

In the case of the normal mode in step ST2, the printer CPU 110 controls the sheet feed timing and the reverse convey speed at values for the normal mode (ST5).

Figure 4:
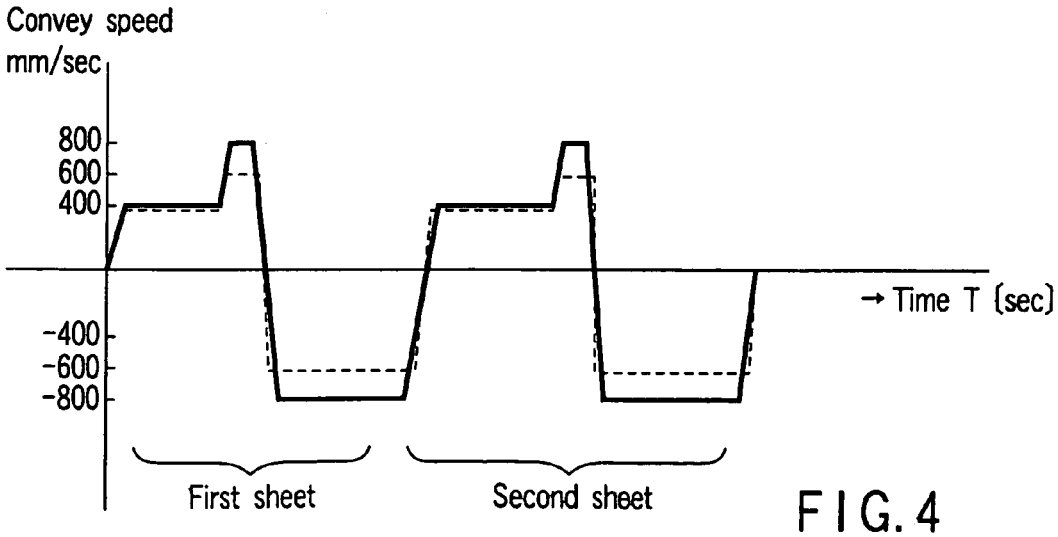
FIG. 4 illustrates convey speed controls for a reverse roller pair in different modes.

FIG. 4 illustrates convey speed controls for the reverse roller pair 29 in different modes. In FIG. 4, the solid line indicates how the sheet-conveying speed is controlled in the normal mode. In the normal mode, the sheet is conveyed, first at 400 mm/sec and then faster at 800 mm/sec, and is conveyed at 800 mm/sec (V1) when the conveying direction is reversed.

In FIG. 4, too, the broken line indicates how the sheet-conveying speed is controlled in the low-speed mode. In the low-speed mode, the sheet is conveyed, first at 400 mm/sec and then faster at 600 mm/sec, and is conveyed at 600 mm/sec (V2) when the conveying direction is reversed. The sheet may be conveyed at 400 mm/sec when the conveying direction is reversed, depending on the type of the sheet.

As has been described above, according to the first embodiment, if the thick paper mode (low-speed mode or low-noise mode) is selected, noise of the reverse roller pair at the time of reversing, noise of friction between the guide and thick sheet, etc., can be reduced.

A second embodiment of the present invention will now be described.

In the second embodiment, a paper sheet is conveyed in the reverse convey path 28 that is reversing section, is reversed with a second reverse convey speed (V2) that is slower than the first revere convey speed (V1) to the automatic double-side unit 1

The reverse conveyance to the sheet output side due to the first mode has already been described above.

The reverse conveyance to the automatic double-side unit 1 will be described referring to FIG. 1.

A paper sheet, on one side of which an image is formed by the printer section 4, is conveyed by the image-fixed sheet output roller pair 25, and then brought to the reverse convey path 28 via the direction-switching gate 26.

The sheet conveyed along the reverse convey path 28 passes through the reverse roller pair 29 and the ADU reverse roller pair 30, and is sensed by the sensor 43. At a predetermined timing from the sensing by the sensor 43, the sheet is reversely conveyed by the ADU reverse roller pair 30. The sheet reversely conveyed by the ADU reverse roller pair 30 is conveyed by the convey roller pairs 5 of the automatic double-side unit 1.

The sheet convey path for the double-side image formation will be described below.

(1) A paper sheet, on one side of which an image is formed by the printer section 4, is conveyed by the image-fixed sheet output roller pair 25, and then guided to the reverse convey path 28 via the direction-switching gate 26. The sheet passes through the reverse roller pair 29 and is then reversely conveyed by the ADU reverse roller pair 30 into the automatic double-side unit 1. Up to three paper sheets are brought into the automatic double-side unit 1.

(2) If three paper sheets are brought into the automatic double-side unit 1, the sheet that was first brought in the automatic double-side unit 1 is fed once again to the printer section 4. An image is thus formed on the other side (reverse side) of the sheet in the printer section 4.

(3) The paper sheet, on both sides of which images have been formed, is conveyed by the image-fixed sheet output roller pair 25 and output to the outside of the machine via the direction-switching gate 26 and output roller pair 27.

(4) Subsequently, another paper sheet, on one side of which an image is formed by the printer section 4, is conveyed by the image-fixed sheet output roller pair 25, and then guided to the reverse convey path 28 via the direction-switching gate 26. The sheet passes through the reverse roller pair 29 and is then reversely conveyed by the ADU reverse roller pair 30 into the automatic double-side unit 1. As a result, the number of paper sheets brought in the automatic double-side unit 1, on one side of each of which an image is formed, becomes three once again.

Then, the next sheet in the automatic double-side unit 1 is fed to the printer section 4 once again. An image is thus formed on the other side (reverse side) of the sheet in the printer section 4.

The double-side image formation is performed in the order of the above steps (2), (3) and (4).

Figure 5:
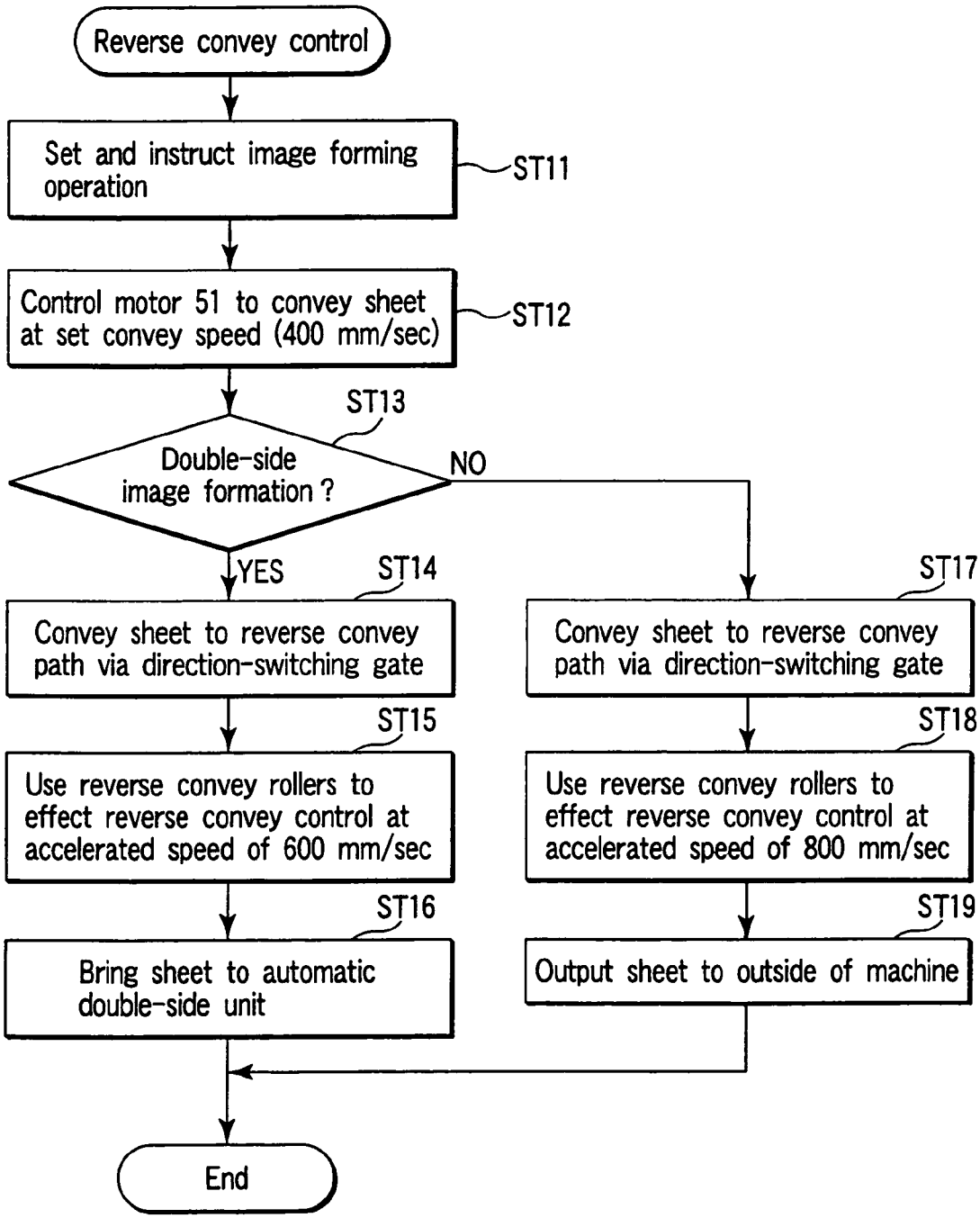
FIG. 5 is a flow chart illustrating a control operation according to a second embodiment of the invention.

The control operation in the second embodiment with the above structure will now be described with reference to a flow chart of FIG. 5.

To start with, a plurality of originals are set in the ADF 8. Setting for an, whether double-side image formation mode or reverse sheet output with single-side image formation mode is to be performed, is instructed through the LCD section 84 of the operation panel 80 (ST11).

When the print key 82 is depressed, the printer CPU 110 controls the motor 51 to convey the sheet at the set convey speed (400 mm/sec) (ST12).

If the setting in step S11 is the double-side image formation mode (ST13), the printer CPU 110 causes the image-fixed sheet output roller pair 25 to convey the sheet, on one side of which an image is formed, at the same convey speed of 400 mm/sec, thus bringing the sheet to the reverse convey path 28 via the direction-switching gate 26 (ST14).

The sheet with the image on one side passes through the nip of the reverse roller pair 29 and the nip between the ADU reverse roller pair 30 at a higher speed of 600 mm/sec. The sheet is then detected by the sensor 43. Upon lapse of a prescribed time from the detection of the sheet, the printer CPU 110 causes the ADU reverse roller pair 30 to rotate in reverse direction to convey the sheet at 600 mm/sec (V2) that is slower than the first revere convey speed (V1) (ST15).

Thus, the printer CPU 110 causes the reversely conveyed sheet to be taken into the automatic double-side unit 1 (ST16).

If the setting in step ST11 is the reverse sheet output with single-side image formation mode (ST13), the printer CPU 110 causes the image-fixed sheet output roller pair 25 to convey the sheet with the image (on one side alone) at the same convey speed of 400 mm/sec, thus bringing the sheet to the reverse convey path 28 via the direction-switching gate 26 (ST17).

The sheet with the image on one side only is conveyed by the reverse roller pair 29, faster at 800 mm/sec and is detected by the sensor 42. Upon lapse of a prescribed time from the detection of the sheet, the printer CPU 110 causes the reverse roller pair 29 to rotate in reverse direction to convey the sheet faster at 800 mm/sec (V1) (ST18).

Thus, the printer CPU 110 outputs the reverse-conveyed sheet to the outside of the machine via the direction-switching gate 26 and the output roller pair 27 (ST19).

Figure 6:
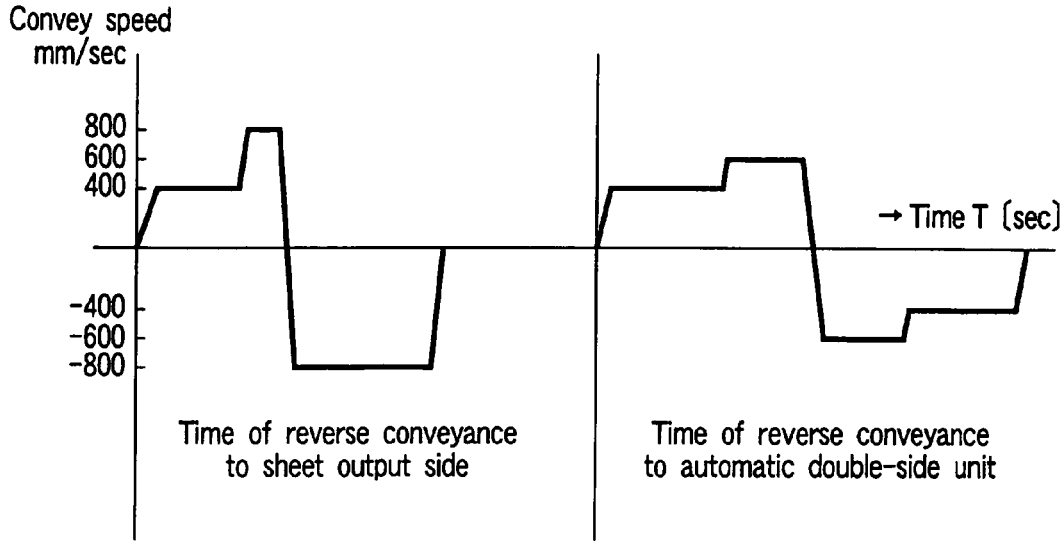
FIG. 6 illustrates a speed control at a time of sheet reverse conveyance in the sheet output direction and a speed control at a time of sheet reverse conveyance to an automatic double-side unit.

FIG. 6 illustrates a speed control at a time of sheet reverse conveyance to the sheet output side and a speed control at a time of sheet reverse conveyance to the automatic double-side unit 1. The left-hand portion in FIG. 6 illustrates the convey speed control for the sheet reverse conveyance to the sheet output side. In this case, the sheet is conveyed at 400 mm/sec, and 800 mm/sec at the time of reverse conveyance.

The right-hand portion in FIG. 6 illustrates the convey speed control for the sheet reverse conveyance to the automatic double-side unit 1. In this case, the sheet is conveyed at 400 mm/sec, and 600 mm/sec at the time of reverse conveyance.

As has been described above, according to the second embodiment, slower reverse convey speeds are set than the reverse convey speed to the sheet output side, and the reverse conveyance performs to the automatic double-side unit 1. Thereby, paper jam at the time of reverse conveyance to the automatic double-side unit is prevented, and noise due to, e.g. abutment, at the time of reverse feed operation, can be reduced.

Figure 7:
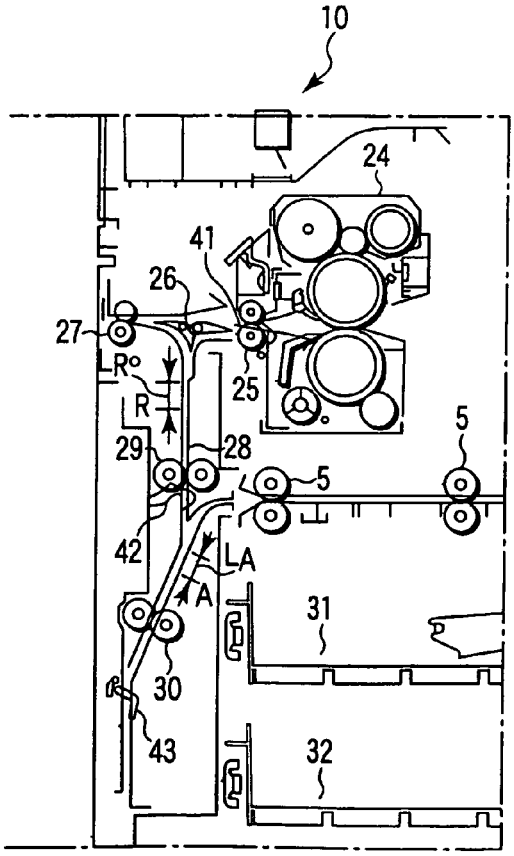
FIG. 7 is an enlarged view of a reverse convey path in the digital copying machine.

FIG. 7 is an enlarged view of the reverse convey path in the digital copying machine 10.

In FIG. 7, a sheet reverse position R at the time of reverse conveyance to the sheet output side is variable due to a convey speed of the image-fixed sheet output roller pair 25 of the fixing device 24 and a convey speed of the reverse roller pair 29. Similarly, a sheet reverse position A at the time of reverse conveyance to the automatic double-side unit 1 is variable due to a convey speed of the image-fixed sheet output roller pair 25 of the fixing device 24 and a convey speed of the ADU reverse roller pair 30.

If the convey speed of the image-fixed sheet output roller pair 25 of the fixing device 24, the reverse roller pair 29 or ADU reverse roller pair 30 varies, the sheet reverse position (R, A) alters, leading to jamming or other problems. In addition, there is a variance among copying machines with respect to the diameter of each roller, fixation convey speed and reverse convey speed.

An optimal sheet reverse position is automatically adjusted at the time of reverse conveyance to the sheet output side or to the automatic double-side unit 1. In addition, such an optimal sheet reverse position can be adjusted by a serviceman.

Figure 8:
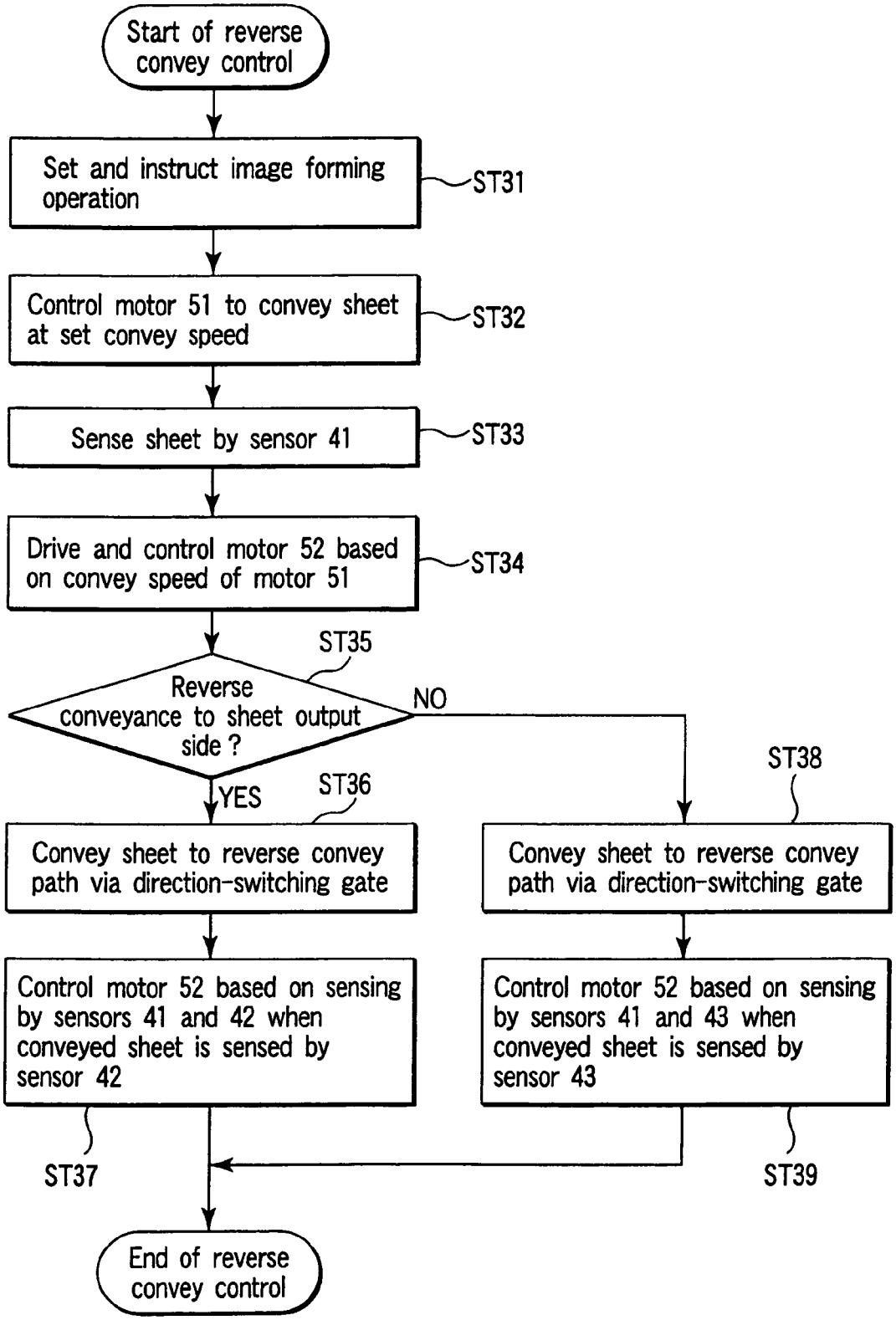
FIG. 8 is a flow chart illustrating a control operation for an optimal reverse position.

The optimal reverse position control operation with the above-described structure will now be described with reference to a flow chart of FIG. 8.

To start with, a plurality of originals are set in the ADF 8. Setting for an image forming operation is instructed through the LCD section 84 of the operation panel 80 (ST31).

The printer CPU 110 controls the fixing device 24 and image-fixed sheet output roller pair 25 at a convey speed set in the printer section 4. Specifically, the printer CPU 110 controls the motor 51 to convey the sheet at a set convey speed (ST32). The sheet is sensed by the sensor 41 when it passes through the image-fixed sheet output roller pair 25 (ST33).

In addition, the printer CPU 110 controls the motor 52 on the basis of the set convey speed of the fixing device 24 and image-fixed sheet output roller pair 25 driven by the motor 51, thereby controlling the convey speed of the reverse roller pair 29 and ADU reverse roller pair 30 (ST34).

The printer CPU 110 determines whether the sheet conveyed by the image-fixed sheet output roller pair 25 is to be reversely conveyed to the sheet output side or to the automatic double-side unit 1 (ST35).

If it is determined in step ST35 that the sheet is to be reversely conveyed to the sheet output side, the printer CPU 110 guides the sheet to the reverse convey path 28 via the direction-switching gate 26 (ST36).

When the sheet passes through the reverse roller pair 29 and is sensed by the sensor 42, the printer CPU 110 controls the motor 52 to drive the reverse roller pair 29 so that the sheet may come to the optimal reverse position R in accordance with the sensing by the sensors 41 and 42 (ST37). In this case, the printer CPU 110 controls the driving of the motor 52 by computing a time period from the sensing of the rear end of the sheet by the sensor 41 to the reaching of the rear end to the optimal reverse position R on the basis of a time period between the sensing by the sensor 41 and the sensing by the sensor 42.

On the other hand, if it is determined in step ST35 that the sheet is to be reversely conveyed to the automatic double-side unit 1, the printer CPU 110 guides the sheet to the reverse convey path 28 via the direction-switching gate 26 (ST38).

When the sheet passes through the reverse roller pair 29 and ADU reverse roller pair 30 and is sensed by the sensor 43, the printer CPU 110 controls the motor 52 to drive the reverse roller pair 29 so that the sheet may come to the optimal reverse position A in accordance with the sensing by the sensors 41 and 42 (ST39). In this case, the printer CPU 110 controls the driving of the motor 52 by computing a time period from the sensing of the rear end of the sheet by the sensor 42 to the reaching of the rear end to the optimal reverse position A on the basis of a time period between the sensing by the sensor 41 and the sensing by the sensor 43.

A serviceman may adjust the control by the CPU 110 to set the optimal reverse position R, A in accordance with the individual copying machine. Specifically, the serviceman causes the LCD section 84 of operation panel 80 to display adjustment codes, and adjusts the speeds of the motors 51 and 52 in accordance with roller diameters, fixation speeds and reverse convey speeds of individual copying machines.

As has been described above, optimal reverse positions can be controlled in accordance with the convey speed at the fixing device and the convey speed at the time of sheet reversing.

According to the above-described embodiments of the invention, when a thick sheet is selected at the time of sheet setting relating to sheet feed cassettes, the reverse convey speed is controlled and decreased. Thereby, noise of the roller pair at the time of reversing, noise of friction between the guide and thick sheet, etc., can be reduced.

In addition, different reverse-convey speeds are set between the reverse conveyance to the sheet output side and the reverse conveyance to the automatic double-side unit. Thereby, paper jam at the time of reverse conveyance to the automatic double-side unit is prevented, and noise due to, e.g. abutment, at the time of reverse feed operation, can be reduced.

Furthermore, the optimal reverse position for stably conveying the sheet at the reverse position is always controlled by computation, whereby paper jamming or other problems can be prevented.

Besides, the adjustment mode may be set through the operation panel, thereby to adjust the speeds of the motors that are reversely driven. Thereby, paper jamming or other problems can be prevented.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus having an image forming section which forms an image on a paper sheet that is fed, comprising:

a first control section that controls a convey speed of the paper sheet on which the image is formed by the image forming section;

a first sensing section that senses the sheet controlled and conveyed by the first control section;

a reversing section that reverses the sheet which comes out of the first sensing section;

a second control section that controls the reversing section at a reverse convey speed corresponding to the convey speed controlled by the first control section;

a second sensing section that senses the sheet which is passing through the reversing section; and a third control section that controls, when the sheet is sensed by the second sensing section, a sheet reversing operation by the reversing section in accordance with sensing by the first sensing section and the second sensing section.

2. The image forming apparatus according to claim 1, wherein the second control section controls the reversing section at a reverse convey speed that is obtained by accelerating the convey speed controlled by the first control section.

3. The image forming apparatus according to claim 1, wherein the first and second sensing sections are actuator-type sensors.

4. The image forming apparatus according to claim 1, wherein the reversing section reverses the paper sheet with the image formed, when the paper sheet is to be output.

5. The image forming apparatus according to claim 1, wherein the reversing section reverses the paper sheet, on one side of which an image is formed, when images are to be formed on both sides of the paper sheet.

6. The image forming apparatus according to claim 1, wherein when the second sensing section senses the paper sheet, the third control section computes an operation time with which the paper sheet is reversed at an optimal reverse position, on the basis of a time period between the sensing by the first sensing section and the sensing by the second sensing section, the convey speed controlled by the first control section, and the reverse convey speed controlled by the second control section, thereby controlling the sheet reverse operation by the reversing section.

7. A method of controlling an image forming apparatus having an image forming section which forms an image on a paper sheet that is fed, comprising:

setting a convey speed of the paper sheet on which the image is to be formed by the image forming section in accordance with an image forming condition for forming the image on the paper sheet;

setting a reverse convey speed of a reversing section that reverses the paper sheet in accordance with the set convey speed;

sensing, by a first sensing section, the paper sheet which is conveyed at the set convey speed and on which the image is formed by the image forming section; and computing, when a second sensing section senses that the paper sheet sensed by the first sensing section is conveyed to the reversing section, an operation time with which the paper sheet is reversed at an optimal reverse position, on the basis of the convey speed and the reverse convey speed in accordance with the sensing by the second sensing section and the sensing by the first sensing section, thereby controlling a sheet reverse operation by the reversing section.

* * * * *